US005327863A

United States Patent [19]

Downton et al.

[11] Patent Number: 5,327,863

[45] Date of Patent: Jul. 12, 1994

[54] INTERCONNECTING ROTARY AND RECIPROCATING MOTION

[75] Inventors: Christopher M. Downton, East Sussex; Geoffrey B. R. Feilden, Gloucestershire, both of United Kingdom

[73] Assignee: Collins Motor Corporation Ltd, East Perth, Australia

[21] Appl. No.: 927,517

[22] PCT Filed: Feb. 21, 1991

[86] PCT No.: PCT/GB91/00274

§ 371 Date: Sep. 10, 1992

§ 102(e) Date: Sep. 10, 1992

[87] PCT Pub. No.: WO91/13244

PCT Pub. Date: Sep. 5, 1991

[30] Foreign Application Priority Data

Feb. 21, 1990 [GB] United Kingdom ..... 9003952
Aug. 15, 1990 [GB] United Kingdom ..... 9017860

[51] Int. Cl.[5] ..... F02B 75/24

[52] U.S. Cl. ..... 123/197.4; 123/48 B; 74/50

[58] Field of Search ..... 123/197.3, 197.4, 48 B, 123/56 R, 56 A; 74/50

[56] References Cited

U.S. PATENT DOCUMENTS 2,122,676 7/1938 Bourke .
2,217,912 10/1940 Lindsey .
4,013,048 3/1977 Reitz .
4,485,768 12/1984 Heniges ..... 123/48 B
4,512,291 4/1985 Kirk ..... 123/197.4
4,559,838 12/1985 Neuenschwander ..... 74/50
4,794,887 1/1989 Valentine .
5,078,017 1/1992 Zornes ..... 74/50
5,131,353 7/1992 Bauer et al. ..... 123/197.4

FOREIGN PATENT DOCUMENTS 0241243 10/1987 European Pat. Off. .
2926391 1/1981 Fed. Rep. of Germany .
374420 7/1907 France .

*Primary Examiner*—Tony M. Argenbright
*Assistant Examiner*—Marguerite Macy
*Attorney, Agent, or Firm*—Flynn, Thiel, Boutell & Tanis

[57] ABSTRACT

An apparatus for converting reciprocating motion to rotary motion and vice-versa. The apparatus includes a reciprocatory assembly guided for reciprocation in a first direction. The reciprocatory assembly includes first and second reciprocating members each terminating in a planar guide surface transverse to the direction of reciprocation; spacing tie means interconnecting the two reciprocatory members at opposite ends of the guide surfaces to maintain the guide surfaces parallel, spaced apart and facing each other; a drive block having opposed guide faces each slidably engaged with a respective one of the guide surfaces of the reciprocatory members; and a rotary member mounted for rotation about an axis transverse to the direction of reciprocation and having an eccentric portion rotatably engaged in the drive block.

16 Claims, 9 Drawing Sheets

26
218
27
133
234
224
219a
119b
219a
119b
36
35
118

INTERCONNECTING ROTARY AND RECIPROCATING MOTION

The present invention relates to apparatus for converting reciprocating motion to rotary motion and vice-versa comprising a reciprocatory assembly guided for reciprocation in a first direction and comprising first and second reciprocating members each terminating in a planar guide surface transverse to the direction of reciprocation, and spacing tie means interconnecting the two reciprocatory members at opposite ends of the guide surfaces to maintain the guide surfaces parallel, spaced apart and facing each other, a drive block having opposed guide faces each slidably engaged with a respective one of the guide surfaces of the reciprocatory members, and a rotary member taunted for rotation about an axis transverse to the said direction of reciprocation and having an eccentric portion rotatably engaged in the drive block.

Such apparatus is particularly suitable for interconnecting pistons with a crankshaft in positive fluid displacement machines such as pumps and internal combustion engines as proposed for example in EP-A 0,241,243 and U.S. Pat. No. 4,794,887.

A problem in such known apparatus arises from deflections of the guide surfaces due to high loads imposed on them particularly at high speeds, under the tensions generated in the tie means and applied at the ends of the guide surfaces while the drive block bears against an intermediate part of one guide surface.

Apparatus according to one aspect of the invention is characterised in that the spacing tie means comprises, at each end of the guide surfaces, two ties positioned one on each side of the end part of the travel of the outer portion of the drive block. Such an arrangement enables the bending moments applied to the guide-surface-forming portions of the reciprocatory members to be reduced since the two sets of tie means are now less far apart. At the same time, the length of the drive block (in the direction of its motion) may be increased, in relation to the eccentricity or throw of the eccentric portion of the rotary member, to a value such that in all positions of the drive block, the central plane of the apparatus passing through the said axis passes through the drive block.

Apparatus according to ,another aspect of the invention is characterised in that the spacing tie means comprises, for each end of the guide surfaces, two side plates positioned one on each side of the reciprocatory members and secured to the two reciprocatory members at least at intervals along the outer portions of the guide surfaces, each side plate having a reentrant providing clearance for the eccentric portion of the rotary member as it moves relatively to the reciprocatory members parallel to the guide surfaces. Preferably, the reentrant is formed by a parallel-sided and curved-ended slot of width sufficient to clear the said eccentric portion but preferably less than the distance between the opposed guide surfaces. Advantageously, the portions of the side plates, beyond the reentrants, which form the tie means, are made sufficiently stiff to maintain the portions each side of the reentrant parallel, thereby reinforcing the end portion of the reciprocatory members forming the guide surfaces.

Where the eccentric portion is formed by a crankpin connected to the remainder of the rotary member (thus in the form of a crankshaft) by webs, the radially outer portions of the webs may advantageously terminate at a smaller distance from the crankshaft axis than the radially outer part of the crankpin so that the latter projects beyond the webs. This enables the side plates to be brought still closer together.

Advantageously, the side plates and the adjacent portions of the reciprocatory members have load-transmitting interfitting formations therealong.

These measures together result in a very rigid construction which reduces deflection of the guide surfaces, preferably in conjunction with the first aspect of the invention.

In one variant of the apparatus, each side plate is made integral with one of two members forming the two said portions of the reciprocatory assembly. Preferably two side plates are integral with one said member and the other two with the other said member.

Advantageously each member is formed integrally with one side plate on one side thereof at one end of its guided surfaces and with its further side plate on the other side and at the other end of this guide surface.

In an alternative variant, the two said portions and the two side plates at one end of the transverse guideway are formed integrally as one component and the other two side plates, at the other end of the guideway are secured to this component at least at intervals.

Also according to the present invention there is provided an eight-cylinder internal combustion engine having a crankshaft with four crankpins and two cylinder banks each of four cylinders the two banks being on opposite sides of the crankshaft axis with their cylinder axes in a common plane through the crankshaft axis, and connecting means connecting each crankpin to a corresponding piston in each bank. By arranging the crankpins in a predetermined order at angles of 0°, 90°, 180° and 270°, equal firing intervals of 90° of crankshaft rotation are obtainable. Advantageously, the apparatus of one or both of the first two aspects of the invention is used for each of the four connecting means.

An embodiment of the invention will now be described by way of example with reference to the accompanying drawings, in which.

Figure 1:
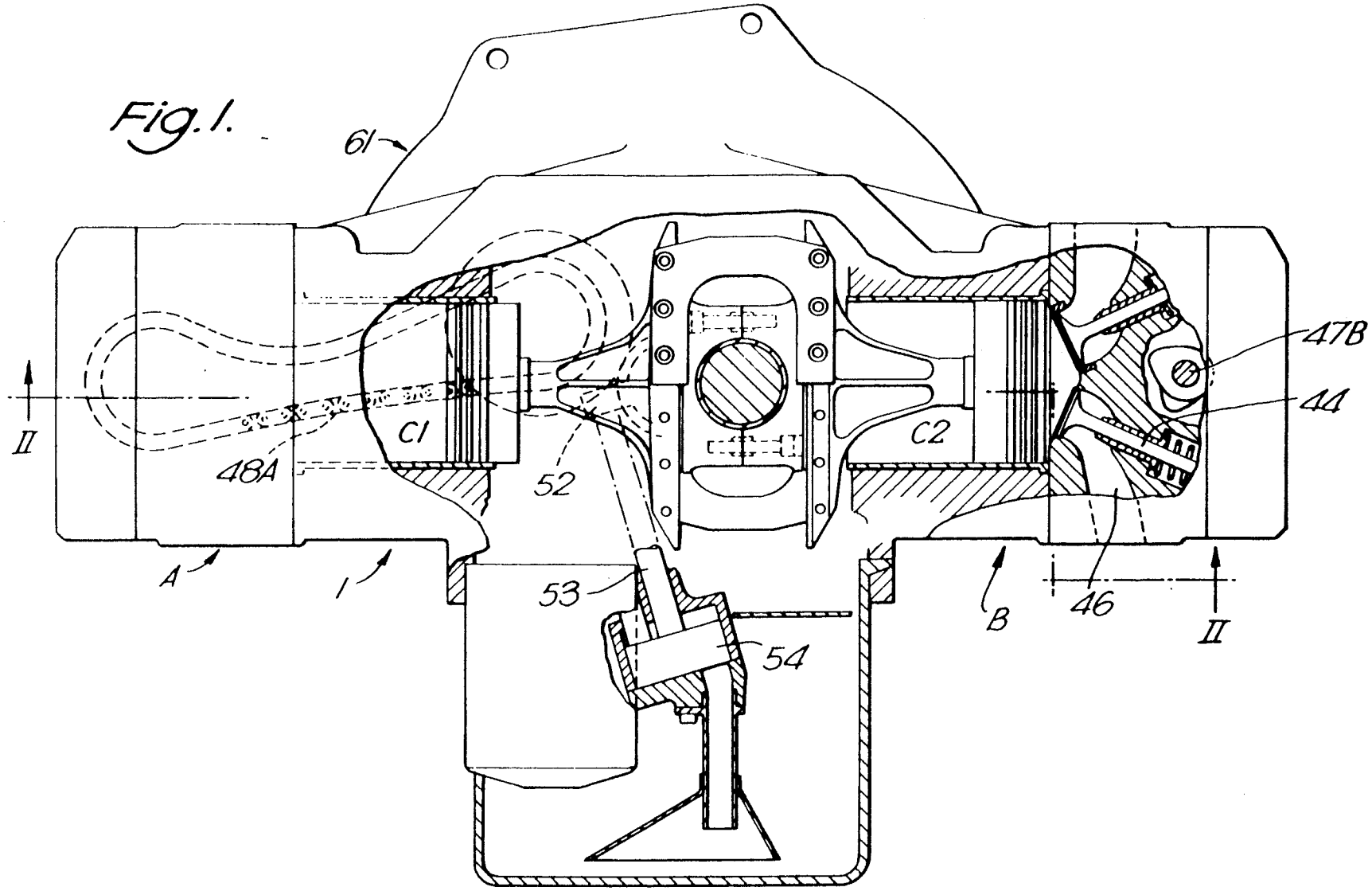
FIG. 1 shows schematically and mainly in section an internal combustion engine according to the invention as seen from the end adjacent the timing gears and chains.
Figure 2:
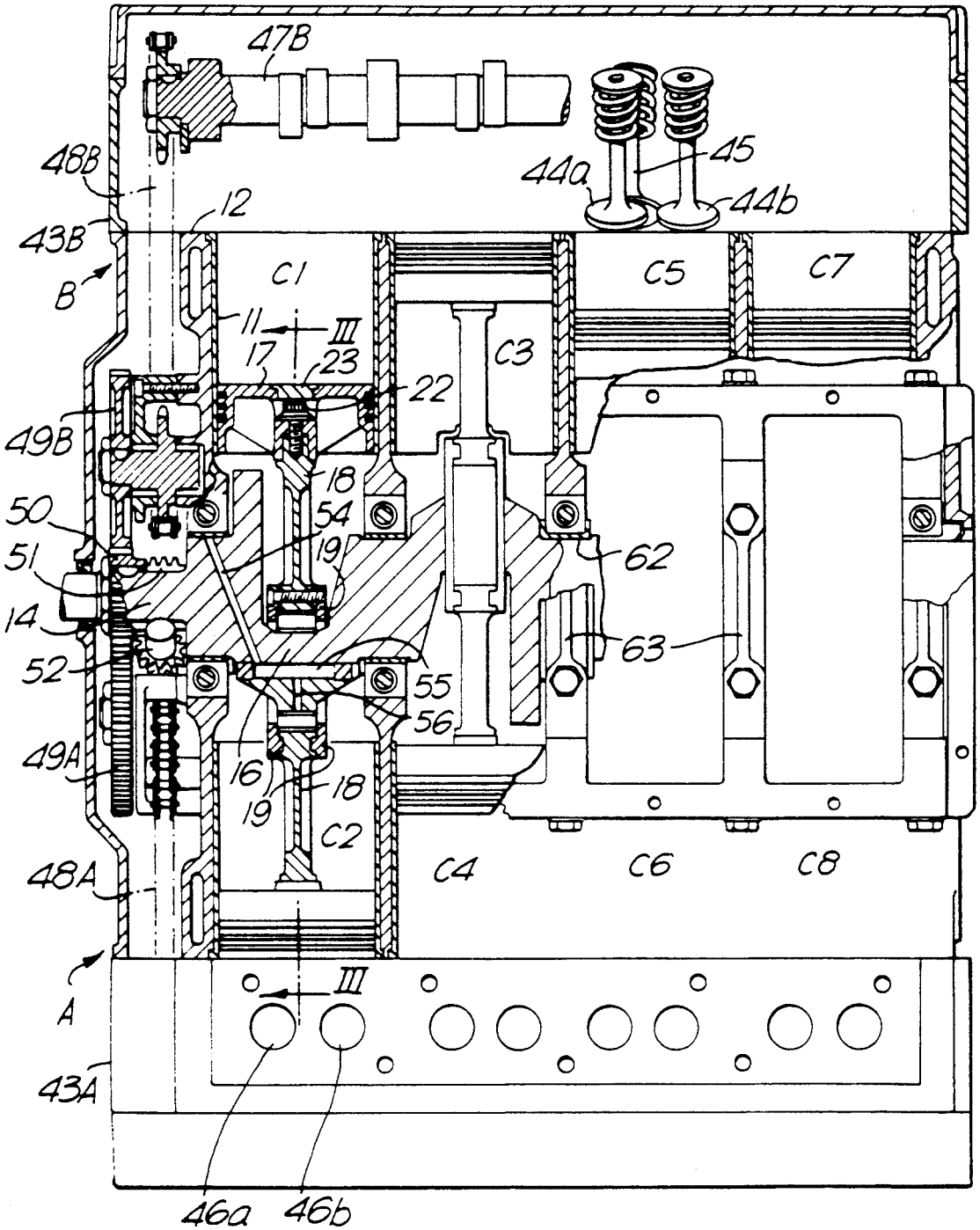
FIG. 2 is a plan view, mainly in section on the line II—II of FIG. 1.

FIGS. 1 and 2 show diagranmatically the principal components of an eight-cylinder horizontally-opposed internal combustion engine having two banks each of four cylinders. The cylinders C1, C3, C5 and C7 are arranged in line in one bank while the other cylinders C2, C4, C6 and C8 are arranged in line in the other bank B. Each cylinder is formed by a cylinder liner 11 all of which are mounted in a crankcase 12, the lower end of which is closed in the normal manner by an oil sump 13.

Each pair of opposed cylinders, such as C1 and C2, are coaxial. A crankshaft 14 is rotatably mounted in five main bearings 15 in the crank case 12 and has four crankpins 16, one for each opposed pair of cylinders. Measured in the direction of rotation of the crankshaft 14, the angular spacings of the crankpins 16 are, from the front of the engine (i.e. the left hand side in FIG. 2) 0°, 180°, 270° and 90°. Thus, the firing order for the engine in four stroke form is 1-6-3-8-4-7-2-5-1.

Each cylinder contains a piston 17. The two pistons 17 of an opposed pair of cylinders such as C1 and C2 are connected together by a reciprocatory connecting assembly shown on an enlarged scale in FIGS. 3 to 5.

Each connecting assembly consists of a connecting link 18 for each piston and four connecting plates 19*a*, 19*b*, 19*c* and 19*d* which are each of a U-shaped formation. Each connecting link 18 has a spigot 20 at one end which engages in a bore in its associated piston 17 and is itself formed with a screw threaded bore to receive a stud 21 carrying a nut 22 securing the piston to the connecting link. Each nut 22 is located in an aperture in the piston crown and this aperture is subsequently closed by a plug 23 screwed into the centre of the piston and suitably locked.

At its other end, each connecting link 18 widens out to form a long rectangular flat guide surface 24 which is surface-hardened, for example by nitriding. The links 18 are stiffened by appropriate ribs in the form of two outer ribs 25 and a central rib 26 with the spaces therebetween formed by web portions 27.

A drive block 28 is formed in two halves 28*a* and 28*b* which are secured together by screws 29 and are accurately located relatively to each other by tubular dowels 30. In opposite faces of the drive block 28 are located bearing plates 31 of appropriate bearing-forming material to engage slidably the guide surfaces 24. Movement of the bearing plates 31 relative to the drive block 28 in the direction along the drive block is prevented by transverse ribs 32 formed at the corners of the drive block.

The two connecting links 18 are secured with their guide surfaces 24 at the correct distance apart by the connecting plates 19 which also reinforce the connecting links against deformation in operation. For this purpose each connecting plate 19 is formed with a rib 33 engaged as a close fit in a corresponding groove 34 extending along each lateral face of the connecting link 18. The connecting plates 19 are secured to the connecting links 18 by screws 35 having heads 36 at one end located in counter bores in one connecting plate and having screw threaded portions at their other ends engaged in screw threaded holes in the opposite plate.

The connecting plates 19 have flange portions 36 which extend inwardly from the guide surface 24 towards each other. These flange portions-increase the rigidity of the connecting links 18 in the region of the guide surfaces and are themselves surface-hardned to form lateral guide surfaces for the drive block 28 and its bearing plates 31. The flange portions 36 bound the parallel sides of a reentrant 37 having a semi-circular end 38. A reentrant 37 provides clearance for the portions of the crankshaft web immediately adjacent the crankpin 16.

Figure 4:
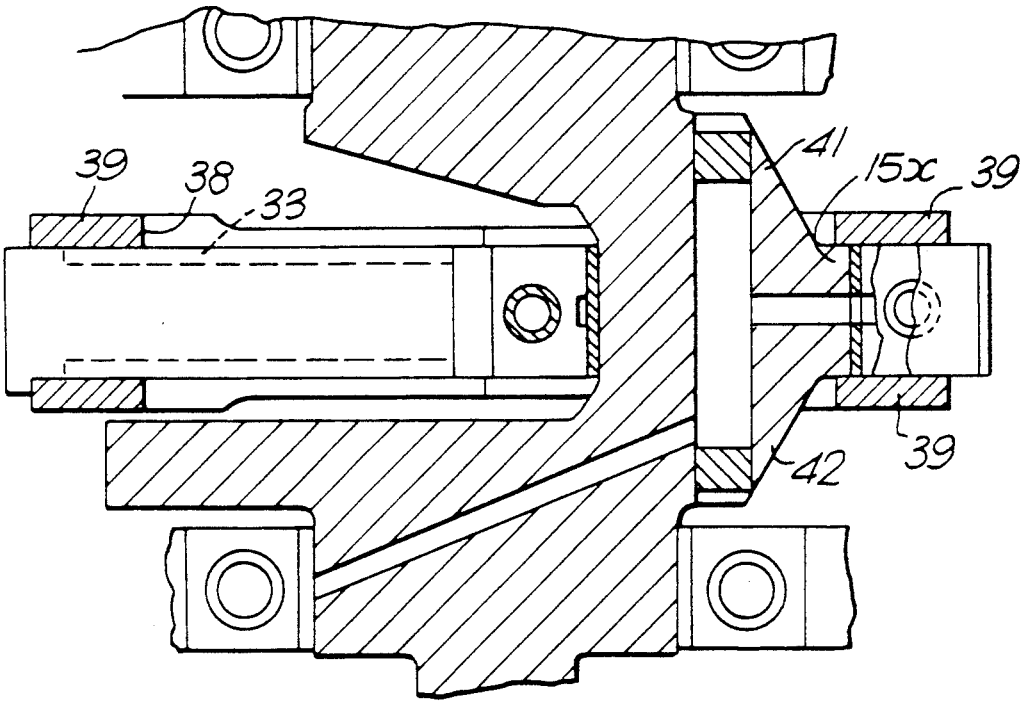
FIG. 4 is a section on the line IV—IV of FIG. 3.
Figure 5:
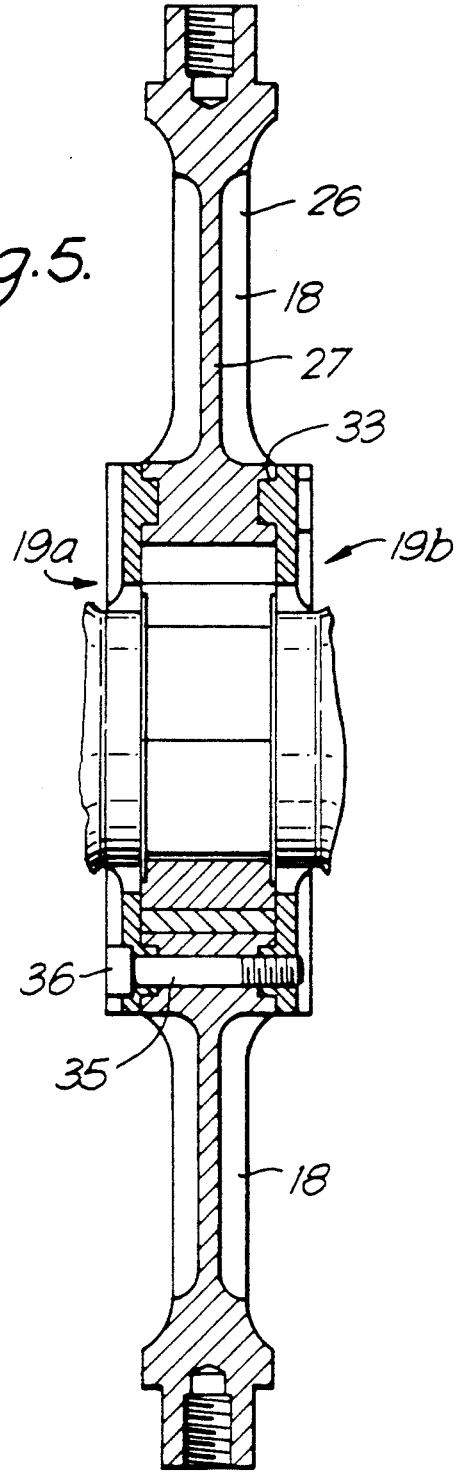
FIG. 5 is a section on the lines V—V of FIGS. 3 and 4.

The stiffness of the connecting plates 19 is increased by increasing the thickness of the connecting link portions 39. The distance between the connecting portions 39 on opposite sides of the central plane is reduced by shaping the crankpin 15 between the two plates at each end as shown in FIG. 4.

Thus, the radially outermost portion 15x of the crankpin projects radially beyond, the radially outer portions of the crankshaft webs 41 and 42. By reducing the distance between the connecting portions 39, the bending moments in the guide surface portions of the connecting links are further reduced.

Figure 3:
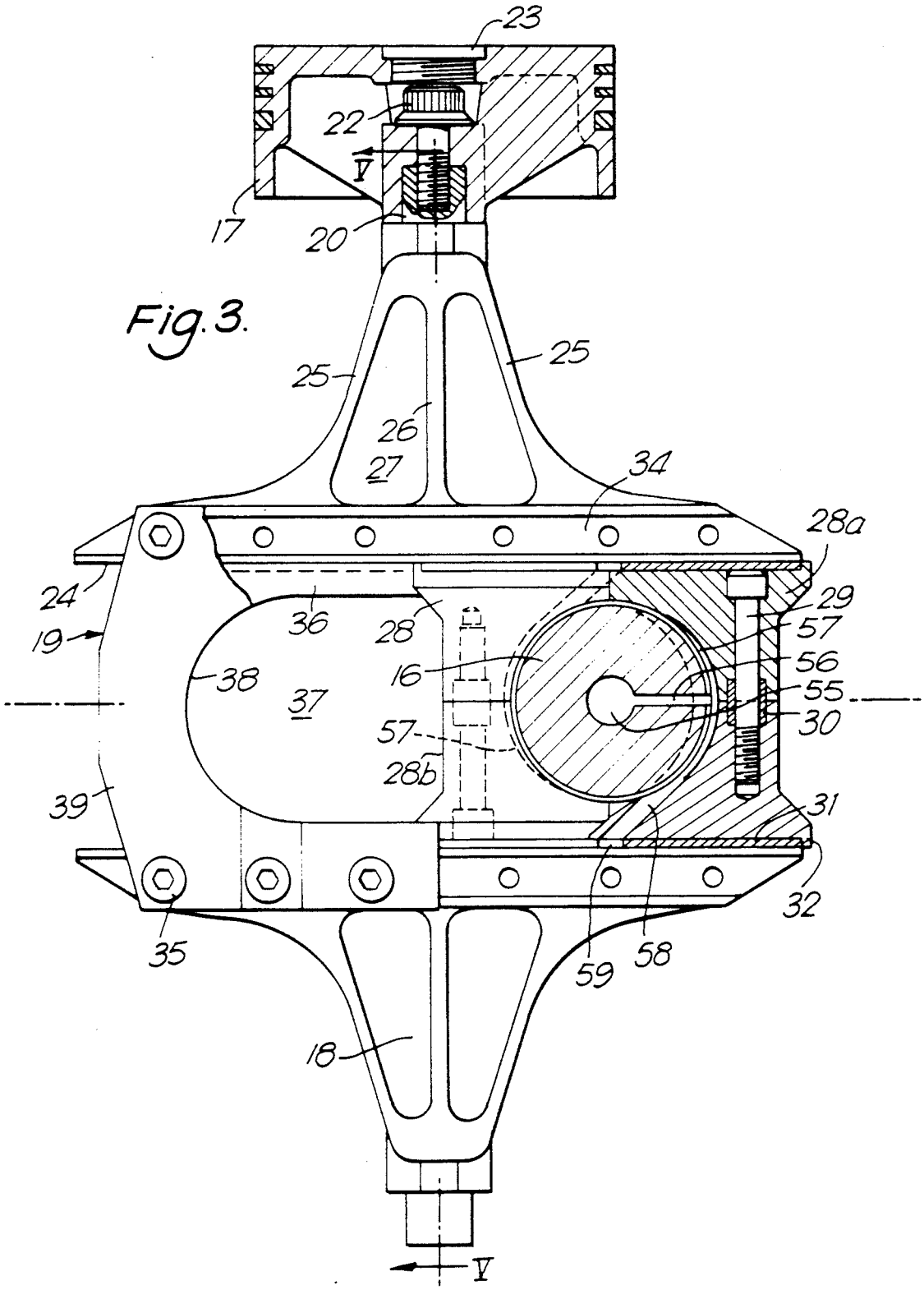
FIG. 3 is a sectional view on the line Ill—Ill of FIG. 2, on an enlarged scale.

As can be seen from FIG. 3, even in the extreme position of its travel along the guide surfaces, the drive block 28 always has some portion on the centre line of the reciprocatory assembly.

Turning again to FIGS. 1 and 2, it will be seen that each bank of cylinders has a respective cylinder head 43 forming combustion chambers for the cylinders. Each combustion chamber has two inlet valves 44*a* and 44*b* and an exhaust valve 45. The cylinder heads ray be formal with separate inlet ducts 46*a* and 46*b* leading to the respective inlet valves or a single inlet duct supplying both valves may be used instead. Where the engine is a spark-ignition engine, each chamber will include a spark plug and the inlet manifold branches (not shown) supplying the inlet ducts will include fuel injectors.

The valves 44 and 45 are operated by a cam shaft in each cylinder head, the cam sheets being of the "single overhead" type operating valves through rocker arms (not shown). The cam shafts are themselves driven at half crankshaft speed by roller-chain and sprocket drives driven by respective timing gears 49 meshing with a gear 50 on the front end of the crankshaft 14.

Also mounted on the front end of the crankshaft 14 is a helical gear 51 meshing with a gear 52 on a shaft 52 driving an oil pump 54 (FIG. 1) which draws oil from the sump 2 and supplies it under pressure to the main bearings 15. Internal drillings 54, 55, 56 in, the crankshaft supply oil from the main bearings to the crankpin bearings in the drive blocks. The drillings 56 also supply oil into an arcuate groove 57 behind the bearing shell in the drive block. The grooves 57 communicate through inclined drillings 58 with central apertures 59 in the bearing plates 31. With this arrangement, oil is delivered to replenish the oil film between the drive plate 31 and guide surfaces 24 just before the imposition of high loads between these two elements.

At its rear end, the crankcase 1 may include or have attached to it a bell housing 61 (FIG. 1) to enclose a flywheel (not shown) and torque convertor (not shown) on the rear end of the engine's crankshaft 14 and to enable the crankcase to be secured to a change speed gear box.

Axial location of the crankshaft 14 may be effected by a suitable main bearing construction 62 at its centre bearing (or at its rear bearing) and the main bearings are completed by normal main bearing caps 63.

Figure 6:
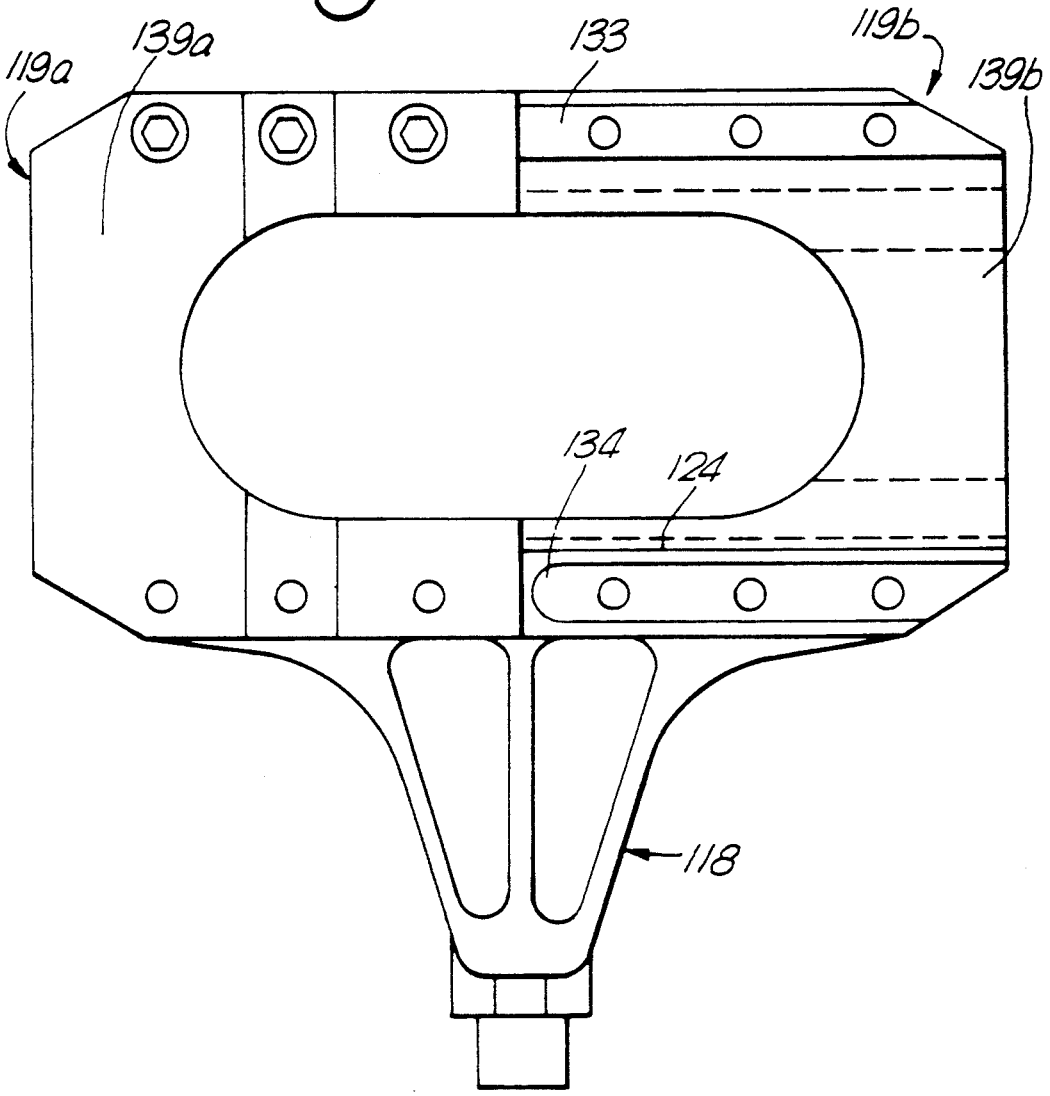
FIG. 6 is an elevational view of one of the two connecting links of the variant.
Figure 7:
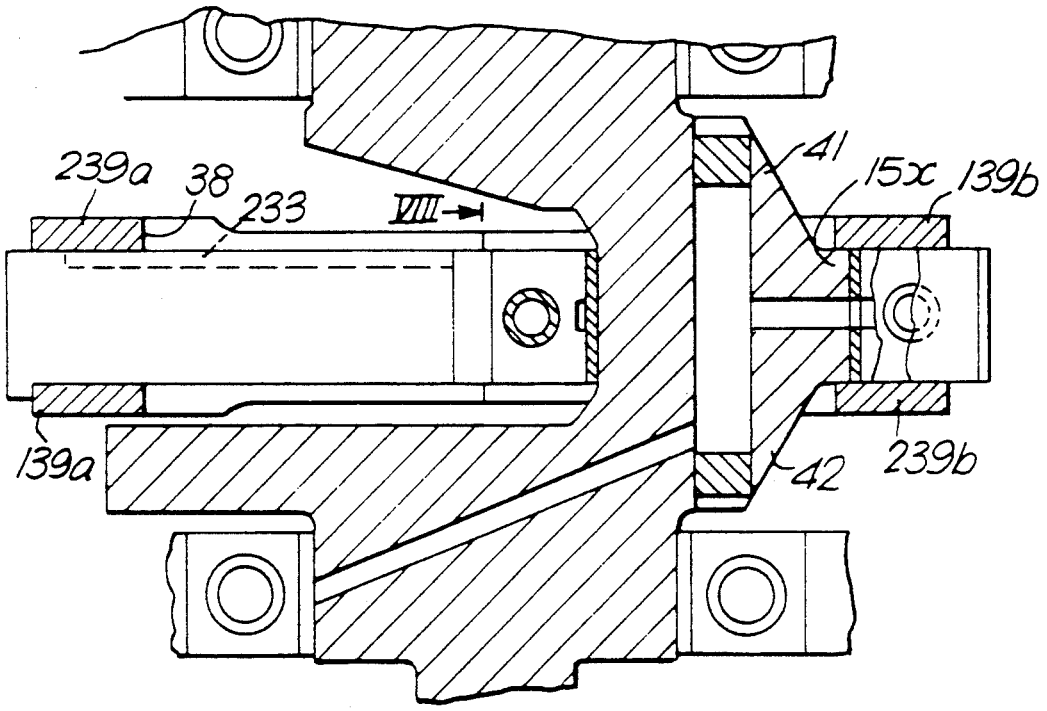
FIGS. 7 and 8 are views similar to FIGS. 4 and 5.
Figure 8:
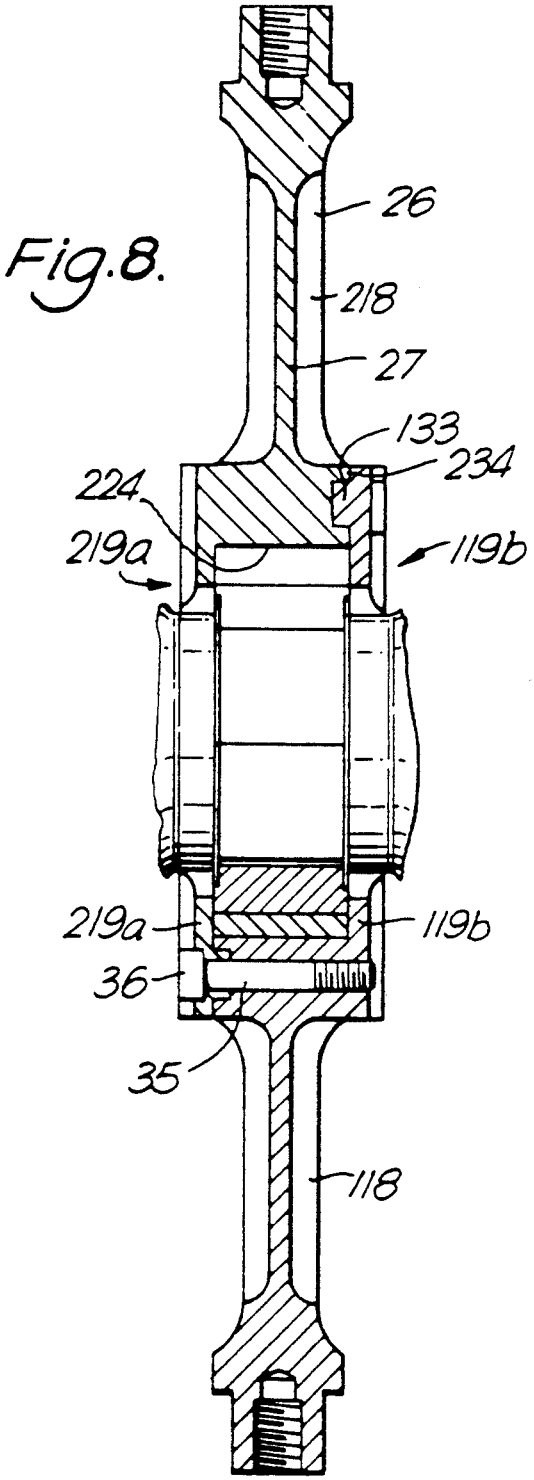
Figure 9:
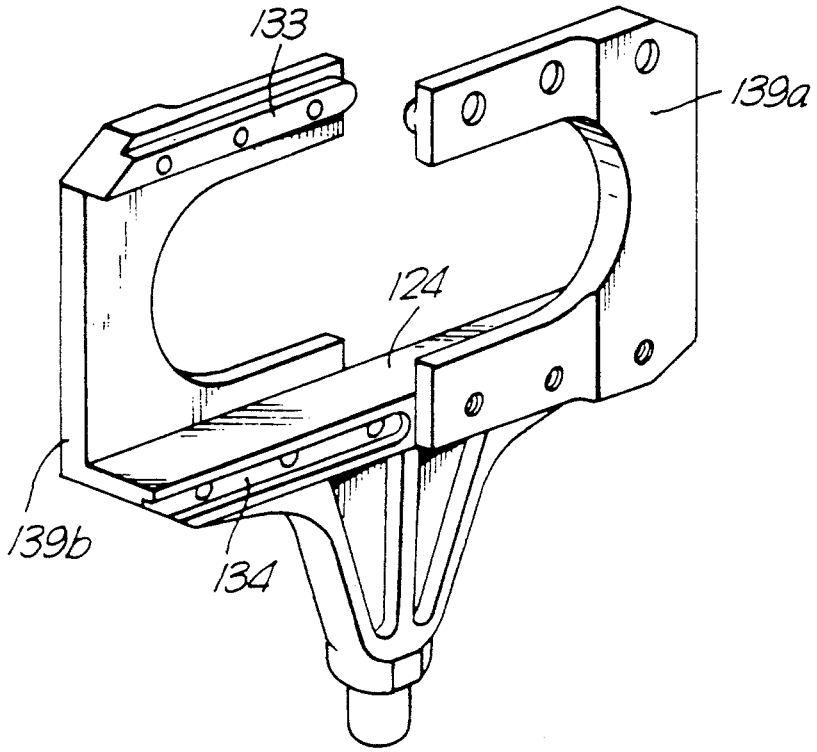
FIG. 9 is a perspective view of the connecting link shown in FIG. 6.

In the variant shown in FIGS. 6 to 8, the reciprocatory assembly is formed by two connecting links 118 and 218 which are in most respects similar to the connecting links 18 shown in FIGS. 1 to 5 of the eve-mentioned application. The two connecting links 118 and 218 are of identical construction. As shown in FIG. 6, a connecting link 118, formed for example as a forging, has integral with it a first side plate 119*a* on the front face of the connecting link as seen in the drawing and a second connecting plate 119*b* at the rear face. Each of the connecting plates 119 extends for half of the length of the connecting link measured in the direction of the guide surface 134. Each connect plate 119 is formed with a rib 133 to engage in a corresponding groove 234 of the other connecting link 218. Similarly, the grooves 134 of the connecting link 118 receive the ribs 233 of the connecting plates 219 of the connecting link 218.

Assembly of the two connecting links together with the drive block therebetween is effected by relative movement towards each other along the direction of reciprocation of the reciprocating assembly with subsequent relative angular adjustment of the two connecting links about an axis extending in this direction (i.e. the common axis of the two opposed cylinders). The two connecting links can then be secured together by screws 35.

In both variants mentioned above, the guide surfaces 124, 224 and the ribs and the grooves may all be formed in a single broaching operation or by appropriate grinding and machining operations.

We claim:

1. Apparatus for converting reciprocating motion to rotary motion and vice-versa comprising a reciprocatory assembly guided for reciprocation in a first direction and comprising first and second reciprocating members each terminating in a planar guide surface transverse to the direction of reciprocation, and spacing tie means interconnecting the two reciprocatory members to maintain the guide surfaces parallel, spaced apart and facing each other, a drive block having opposed guide faces each slidably engaged with a respective one of the guide surfaces of the reciprocatory members for travel therealong, and a rotary member mounted for rotation about an axis transverse to the direction of reciprocation and having an eccentric portion rotatably engaged in the drive block, and spacing tie means comprising two pairs of side plates, said pairs being associated respectively one with each end of said guide surfaces, each said side plate having a reentrant providing clearance for said eccentric portion of the rotary member during movement of said rotary member relative to said reciprocating members, securing means securing portions of each said side plate on opposite sides of said reentrant respectively to said reciprocatory members at intervals along said side plate portions, said side plate portions and said reciprocatory members having load-transmitting interfitting depressed and protruding formations therealong.

2. Apparatus according to claim 1, wherein the reentrant is formed by a parallel-sided and curved-ended slot of width sufficient to clear said eccentric portion.

3. Apparatus according to claim 2, wherein the width of the slot is less than the distance between the opposed guide surfaces.

4. Apparatus according to claim 1, wherein portions of the side plates, beyond the reentrants, which form the tie means, are thickened to reinforce the end portion of the reciprocatory members forming the guide surfaces.

5. Apparatus according to claim 1, wherein the drive block has a range of sliding travel along said guide surfaces, and portions of the side plates beyond the reentrants are positioned on each side of an end part of the travel range of an outer portion of the drive block.

6. Apparatus according to claim 1, wherein each side plate is made integral with one of the reciprocating members forming the reciprocatory assembly.

7. Apparatus according to claim 6, where two said side plates are integral with one said reciprocating member and the other two with the other said reciprocating member.

8. Apparatus according to claim 7, wherein each said reciprocating member is formed integrally with one side plate on one side thereof at one end of its guide surfaces and is formed integrally with a further side plate on the other side thereof and at the other end of the guide surface.

9. Apparatus according to claim 7, wherein said adjacent portions of said reciprocatory members and the two side plates at one end of the transverse guide surfaces are formed integrally as one component and the other two side plates, at the other end of the transverse guide surfaces, are secured to said one component at least at intervals.

10. Apparatus according to claim 1, wherein the eccentric portion is formed by a crankpin connected to a portion of the rotary member by webs, and radially outer portions of the webs terminate at a smaller distance from a crankshaft axis than a radially outer part of the crankpin so that the latter projects beyond the webs.

11. Apparatus according to claim 1 in which said load-transmitting interfitting formations are of tongue-in-groove cross section.

12. Apparatus according to claim 11 in which said load-transmitting interfitting formations comprise a rib on one said plate and a groove on the enclosed adjacent portion of one said reciprocating member receiving said rib, said rib and groove each having a length extending in a direction transverse to both said reciprocating direction and the rotation axis of said rotary member, said rib extending into said groove in a direction substantially parallel to said rotation axis and corresponding to the height of said rib and the depth of said groove, said rib and groove each having a width measured substantially in said reciprocating direction, interference of said rib and groove positively blocking relative displacement of said reciprocating member with respect to said side plate in said reciprocating direction.

13. Apparatus according to claim 12 in which said securing means extend and act substantially in said rib height direction for clamping said side plates to said reciprocating members.

14. Apparatus according to claim 13 in which a given said reciprocating member is sandwiched between said side plates, a pair of said ribs protruding heightwise from said side plates and being received depthwise in corresponding ones of said grooves on opposite sides of said given reciprocating member, said securing means comprising screws, a given said screw extending through one said side plate and said given reciprocating member into the other said side plate, said screws extending through said ribs and grooves and blocking escape of said ribs from said grooves.

15. Apparatus according to claim 14 in which said ribs and grooves are of snug interfitting rectangular cross section having opposed faces substantially perpendicular to said reciprocating direction.

16. Apparatus according to claim 2 in which said side plates are each of deep U-shape defined by elongate parallel legs and a bight rigidly joining opposed first ends of said legs, said legs having second ends which are free and spaced from each other across said rentrant, said guide surfaces extending along said legs, said free second leg ends of one U-shaped plate closely opposing said free second leg ends of a second U-shaped side plate, for forming an oval opening for the eccentric portion of the rotary member, said legs defining elongate sides of said oval opening and said bights defining narrow ends of said oval opening.

* * * * *

UNITED STATES PATENT AND TRADEMARK OFFICE

CERTIFICATE OF CORRECTION

PATENT NO. : 5 327 863

DATED : July 12, 1994

INVENTOR(S) : Christopher M. Downton, et al

It is certified that error appears in the above-indentified patent and that said Letters Patent is hereby corrected as shown below:

Column 5, line 32; change "block, and spacing" to ---block, said spacing---.

Column 6, line 60; change "said rentrant," to ---said reentrant,---.

Signed and Sealed this

Twenty-fifth Day of October, 1994

*Attest:*

*Attesting Officer*

BRUCE LEHMAN

*Commissioner of Patents and Trademarks*